US006863318B2

(12) United States Patent
Mejean et al.

(10) Patent No.: US 6,863,318 B2
(45) Date of Patent: Mar. 8, 2005

(54) LATCH FOR A VEHICLE DOOR

(75) Inventors: Veronique Mejean, Saint Die (FR); Marc Madeddu, Saint-Leonard (FR)

(73) Assignee: ArvinMeritor Light Vehicle Systems (UK) Limited (GB)

( * ) Notice: Subject to any disclaimer, the term of this patent is extended or adjusted under 35 U.S.C. 154(b) by 56 days.

(21) Appl. No.: 10/405,946

(22) Filed: Apr. 2, 2003

(65) Prior Publication Data

US 2003/0222463 A1 Dec. 4, 2003

(30) Foreign Application Priority Data

Apr. 2, 2002 (GB) ..... 0207523

(51) Int. Cl.[7] ..... E05C 3/06

(52) U.S. Cl. ..... 292/201; 292/199; 292/216; 292/DIG. 23

(58) Field of Search ..... 292/201, 216, 292/199, DIG. 23

(56) References Cited

U.S. PATENT DOCUMENTS

| | | | | | |
|---|---|---|---|---|---|
| 3,359,767 | A | * | 12/1967 | Alfonsas et al. | 70/264 |
| 3,386,761 | A | * | 6/1968 | Johnstone et al. | 292/201 |
| 4,575,138 | A | * | 3/1986 | Nakamura et al. | 292/216 |
| 4,624,491 | A | * | 11/1986 | Vincent | 292/201 |
| 4,913,477 | A | * | 4/1990 | Watanuki et al. | 292/216 |
| 4,948,183 | A | * | 8/1990 | Yamada | 292/199 |
| 5,186,504 | A | * | 2/1993 | Takaishi et al. | 292/216 |
| 5,494,322 | A | * | 2/1996 | Menke | 292/216 |
| 5,634,677 | A | * | 6/1997 | Buscher et al. | 292/216 |
| 5,802,894 | A | * | 9/1998 | Jahrsetz et al. | 70/264 |
| 6,003,910 | A | * | 12/1999 | Dupont et al. | 292/201 |
| 6,145,354 | A | | 11/2000 | Kondo et al. | |
| 6,328,353 | B1 | * | 12/2001 | Barczynski et al. | 292/216 |
| 6,349,983 | B1 | * | 2/2002 | Dupont et al. | 292/201 |
| 6,499,776 | B2 | * | 12/2002 | Takamura | 292/201 |
| 6,550,825 | B2 | * | 4/2003 | Ostrowski et al. | 292/199 |
| 6,557,910 | B2 | * | 5/2003 | Amano | 292/201 |
| 6,685,239 | B2 | * | 2/2004 | Yamauchi et al. | 292/201 |
| 6,719,333 | B2 | * | 4/2004 | Rice et al. | 292/216 |
| 2001/0035653 | A1 | * | 11/2001 | Hayakawa et al. | 292/201 |
| 2001/0038211 | A1 | * | 11/2001 | Hayakawa et al. | 292/201 |
| 2002/0117863 | A1 | * | 8/2002 | Shinkawa | 292/216 |

FOREIGN PATENT DOCUMENTS

| | | |
|---|---|---|
| GB | 2 142 078 | 1/1985 |
| GB | 2 307 272 | 5/1997 |
| GB | 2 309 482 | 7/1997 |
| GB | 2 333 319 | 7/1999 |

* cited by examiner

*Primary Examiner*—Daniel P. Stodola
*Assistant Examiner*—Carlos Lugo
(74) *Attorney, Agent, or Firm*—Carlson, Gaskey & Olds

(57) ABSTRACT

A latch of a vehicle door includes a retention plate having a shut face portion and a perpendicular inside face portion. The latch further includes a rotatable claw, a pawl resiliently biased into contact with the claw, and an intermediate release lever. The intermediate release lever has an axis of rotation substantially perpendicular to the axes of rotation of the claw and the pawl. During power release of the latch, a controller signals a power release actuator to rotate the intermediate release lever. The power release actuator is positioned in the plane of the inner face portion of the retention plate. As the intermediate release lever rotates, the cam surface of the intermediate release lever operatively rotates the pawl to disengage the claw and release the striker. If there is a failure of the power release mechanism, the mechanical linkage from the inside or outside door handle can be used to rotate the intermediate release lever and release the claw.

17 Claims, 3 Drawing Sheets

LATCH FOR A VEHICLE DOOR

This application claims priority to Great Britain patent application GB 0207523.2 filed on Apr. 2, 2002.

BACKGROUND OF THE INVENTION

The present invention relates generally to a latch. More particularly, the present invention relates to a latch for a vehicle door having a power release function.

Typically, prior art vehicle side passenger door latches having a power release function have the motor and mechanism that provides the electric release in a portion of the latch that extends substantially parallel to the shut face of the door to which the latch is mounted. However, as the space available for vehicle latch mechanisms decreases due to the fitting of other components within a vehicle door, the fitting of power release motors and mechanisms in this space is increasingly difficult.

Additionally, a further constraint on latch design is the need to retain a mechanical linkage that is redundant under normal operating conditions, but which enables the latch to be released after a crash, for example when power to the electric release may be interrupted.

Hence, there is a need in the art for a latch having a release mechanism located in a different area of the latch to overcome the problems of the prior art.

SUMMARY OF THE INVENTION

A latch of a vehicle door includes a retention plate having a shut face portion and a perpendicular inner face portion. The shut face portion is arranged parallel to a shut face of the vehicle door, and the inside face portion is arranged parallel to an inner face of the vehicle door. The retention plate further includes an opening that receives a striker.

The latch further includes a rotatable claw having a mouth that receives the striker. A rotatable pawl is resiliently biased into contact with the claw. A pawl lifter is co-axially mounted with the pawl. The claw and the pawl move in planes substantially parallel to the plane of the shut face portion. The latch further includes a pivotally mounted intermediate release lever and a pivotally mounted inside release lever having each having an axis of rotation substantially perpendicular to the axes of rotation of the claw and the pawl.

During power release of the latch, a controller signals a power release actuator to operatively rotate the intermediate release lever counter-clockwise. The power release actuator is positioned in the plane of the inside face portion of the retention plate. As the intermediate release lever rotates, a cam surface contacts a projection on the pawl lifter, rotating the pawl lifter and the pawl. As the pawl rotates, the pawl disengages from the claw. The claw is then resiliently biased clockwise to release the striker.

If there is a failure of the power release mechanism, the mechanical linkage from the inside or outside door handle can be used to manually release the latch. By pulling the inside door handle, the inside release lever rotates in a counter-clockwise direction. The inside release lever transmits drive to the intermediate release lever by a projection on an arm. The intermediate release lever then rotates to release the claw in the same way as during power release of the latch.

The latch can be superlocked by moving the arm such that the projection is not received between the intermediate release lever and the inside release lever. Superlocking provides a break in the transmission path between the inside release lever and the intermediate release lever, preventing the latch from being manually released.

These and other features of the present invention will be best understood from the following specification and drawings.

BRIEF DESCRIPTION OF THE DRAWINGS

Exemplary embodiments of the present invention will now be described, by way of example only, with reference to the accompanying drawings in which.

DETAILED DESCRIPTION OF THE PREFERRED EMBODIDMENT

Figure 1:
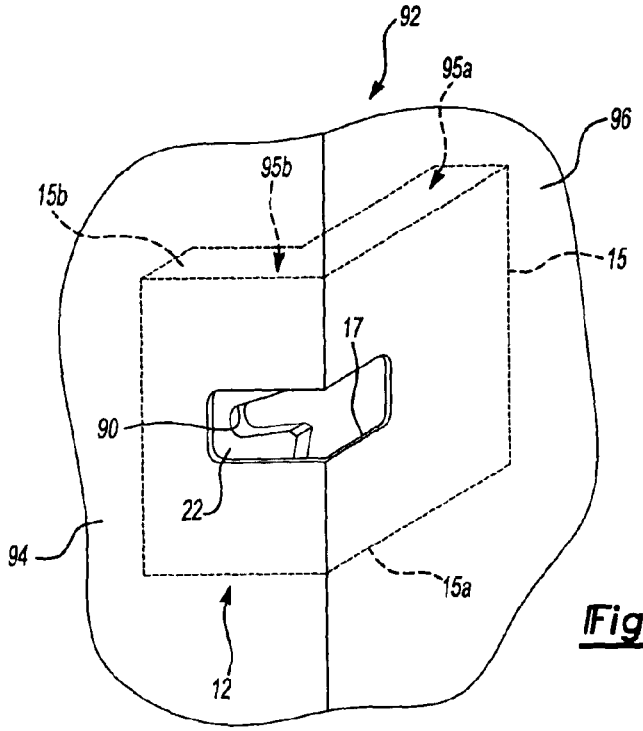
FIG. 1 shows a perspective view of a portion of a vehicle door incorporating the latch of the present invention.

FIG. 1 illustrates the latch 12 of the present invention. The latch 12 includes a retention plate 15 having a shut face portion 15*b* and a substantially perpendicular inside face portion 15*a*. The shut face portion 15*b* is arranged substantially parallel to a shut face 94 (the face on the trailing edge of a conventional passenger side door) of a vehicle door 92 to which the latch 12 is fitted. The inside face portion 15*a* is arranged substantially parallel to an inner face 96 of the vehicle door 92 to which the latch 12 is fitted. The inside face portion 15*a* and the shut face portion 15*b* of the retention plate 15 provide support for the components mounted in an inside face portion or region 95*a* and a shut face portion or region 95*b* of the latch 12, either directly or indirectly. An opening 17 in the retention plate 15 spans the intersection of the portions 15*a* an 15*b* and receives a striker.

Figure 2:
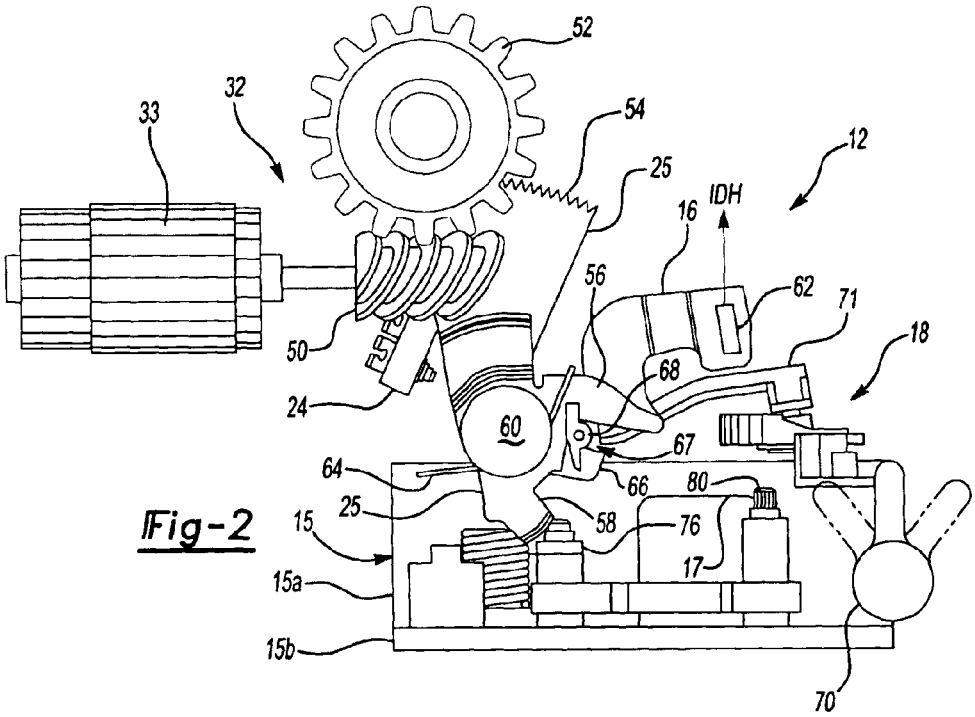
FIG. 2 shows a side view of the latch of the present invention in a rest position with the latch in a latched state.
Figure 3:
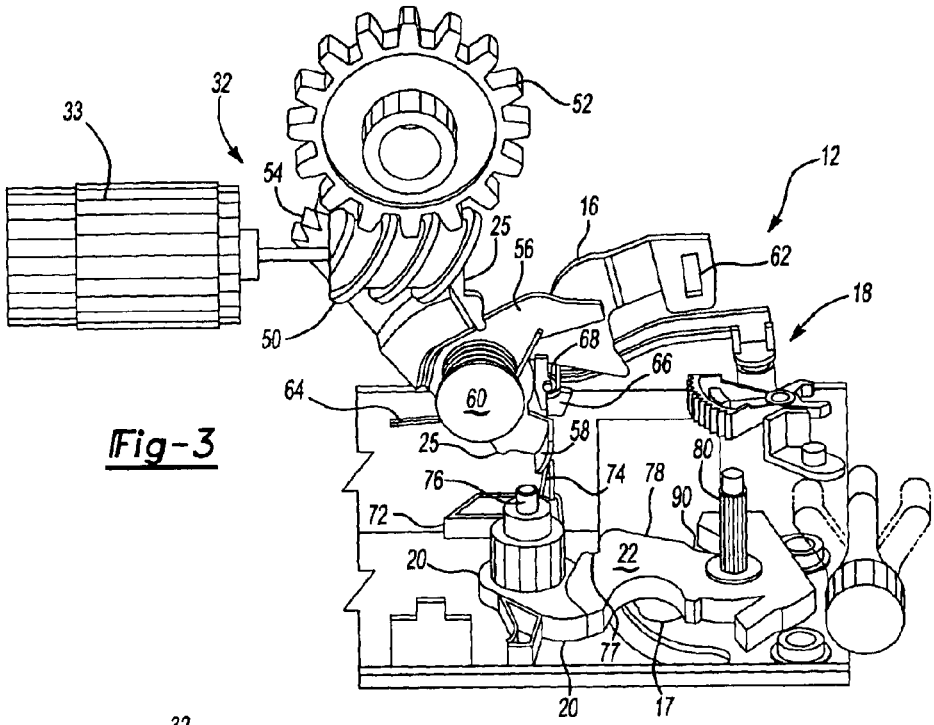
FIG. 3 shows a perspective view of the latch of FIG. 2 with the latch in a released state due to actuation of a power release actuator.

FIG. 2 illustrates the latch 12 in the rest position in a latched state, and FIG. 3 illustrates the latch 12 in a released state due to the actuation of a power release actuator 32. A latch bolt in the form of a rotatable claw 22 is pivotally mounted about a pin 80. The claw 22 is resiliently biased to an open position by a spring (not shown). The claw 22 is provided with a mouth 90 arranged to receive the co-operating striker mounted on a door surround. The claw 22 includes a first safety abutment surface 77 and a fully latched abutment surface 78 (shown in FIG. 3).

A pawl 20 is rotatably mounted about a pin 76 secured to the shut face portion 15*b* of the retention plate 15. The pawl 20 is resiliently biased into contact with the claw 22. When either the first safety abutment surface 77 or the fully latched abutment surface 78 of the claw 22 engages pawl 20, the mouth 90 of the claw 22, in conjunction with the opening 17 in the retention plate 15, releasably retains the striker.

A pawl lifter 72 is also co-axially mounted with pawl 20 on the pin 76. There is a lost motion connection between the pawl 20 and the pawl lifter 72, enabling the pawl 20 to pivot in a clockwise direction when viewed from above when the pawl lifter 72 is stationary. The pawl 20 is resiliently biased into contact with the claw 22. The claw 22, the pawl 20, and the pawl lifter 72 move in planes substantially parallel to the planes of the shut face portion 15*b* of the retention plate 15 and the shut face 94 of the door 92. The pawl lifter 72 further includes a projection 74 extending in substantially the same direction as pins 76 and 80.

An intermediate release lever 25 is pivotally mounted about a pin 60. The pin 60 is arranged such that the axis of rotation of intermediate release lever 25 is substantially perpendicular to the axes of rotation of the pawl 20 and the claw 22. Therefore, the plane of the intermediate release lever 25 is substantially parallel to the plane of the inside face portion 15*a* of the retention plate 15. The intermediate release lever 25 is biased to the rest position shown in FIG. 2 by a torsion spring 64 mounted about the pin 60. The intermediate release lever 25 further includes a nose portion 56 and a cam surface 58. The projection 74 of the pawl lifter 72 is arranged to be contacted by the cam surface 58.

The power release actuator 32 drives the intermediate release lever 25. The power release actuator 32 includes an electric motor 33 that drives a reduction gear 52 via a worm wheel 50. The teeth on the gears are preferably cut to enable the electric motor 33 to be back-driven via the reduction gears. In turn, a pinion (not shown) mounted on the rear face of the reduction gear 52 meshes with a sector gear 54 provided on an end of the intermediate release lever 25 remote from the cam surface 58. As the power release actuator 32 operates, the intermediate release lever 25 pivots about the pin 60.

The term "power release actuator" should be understood to encompass any actuator driven from a vehicle power source, such as a vehicle battery. Specifically, the term should not be understood to mean an actuator such as a door handle whose power source is a vehicle user.

An inside release lever (IRL) 16 pivots co-axially with the intermediate release lever 25 about the pin 60. The inside release lever 16 is resiliently biased in a clockwise direction into a rest position. The inside release lever 16 further includes a nose portion 66. A hole 62 in the inside release lever 16 remote from the pin 60 connects the inside release lever 16 to an inside door handle (IDH) 14 mounted on the inner face 96 of the door 92. The linkage comprises a Bowden cable (not shown), or any other suitable means of connection.

The nose portions 56 and 66 are arranged to form a mouth 67 when both the inside release lever 16 and intermediate release lever 25 are in their rest positions. The inside locking mechanism 18 includes a sector gear 69 pivotally mounted to the latch 12 and driven by an inside locking motor 26 (shown in FIG. 4).

An arm 71 is pivotally mounted to the gear 69 in a position eccentric from the axis of rotation of the gear 69 such that rotation of the gear 69 causes substantially linear movement of the arm 71. An engagement formation 68 on an end of the arm 71 is arranged between the nose portion 56 of the intermediate release lever 25 and the nose portion 66 of inside release lever 16 to provide a driving connection between the intermediate release lever 25 and the inside release lever 16 when engagement occurs.

The latch 12 can be manually released by actuation of the inside door handle 14 to cuase counter-clockwise rotation of the inside release lever 16. The nose portion 66 of the inside release lever 16 transmits drive, via the engagement formation 68, to the intermediate release lever 25 via the nose portion 56. The inside release lever 16 may return to its rest position without the intermediate release lever 25 returning to its rest position. An inside release lever switch 24 is arranged to detect actuation of either the inside release lever 16 or the intermediate release lever 25 and provides a signal to a controller 30 associated with the latch 12.

An inside locking mechanism 18 provides a superlocking function. When the latch 12 is superlocked, the engagement formation 68 is disengaged from the mouth 67 to provide a break in the transmission path from the inside release lever 16 to the intermediate release lever 25. Therefore, the nose portion 66 of the inside release lever 16 the does not engage the engagement formation 68, and the inside release lever 16 rotates without transmitting drive to the intermediate release lever 25.

The latch 12 may be superlocked manually by rotating a selector 70 into a first position by a key or the like. The selector 70, by a linkage (not shown) to sector gear 69, causes the sector gear 69 to rotate into the superlocking position. The sector gear 69 moves the arm 71 such that the engagement formation 68 cannot transmit drive from the inside release lever 16 to the intermediate release lever 25. The selector 70 is also rotatable into a second position that causes an outside locking mechanism (not shown) on the latch 12 to be in a locked state while the inside locking mechanism 18 remains in an unlocked (non superlocked) state.

As shown in FIG. 3, during power release of the latch 12, the controller 30 signals the power release actuator motor 33 to drive the reduction gear 52. The reduction gear 52 engages the sector gear 54 on the end of the intermediate release lever 25, rotating the intermediate release lever 25 in a counter-clockwise direction. The cam surface 58 of the intermediate release lever 25 contacts the projection 74 on the pawl lifter 72, causing the pawl lifter 72, and therefore the pawl 20, to rotate in a clockwise direction when viewed from above. As the pawl 20 rotates, the pawl 20 disengages from the abutment surfaces 76 or 78 of the claw 22. The claw 22 is resiliently biased clockwise to release the striker. When the claw 22 rotates clockwise, the door ajar (DA) switch 28 (shown in FIG. 5) signals to the controller 30 to indicate that release of the claw 22 has occurred.

Figure 4:
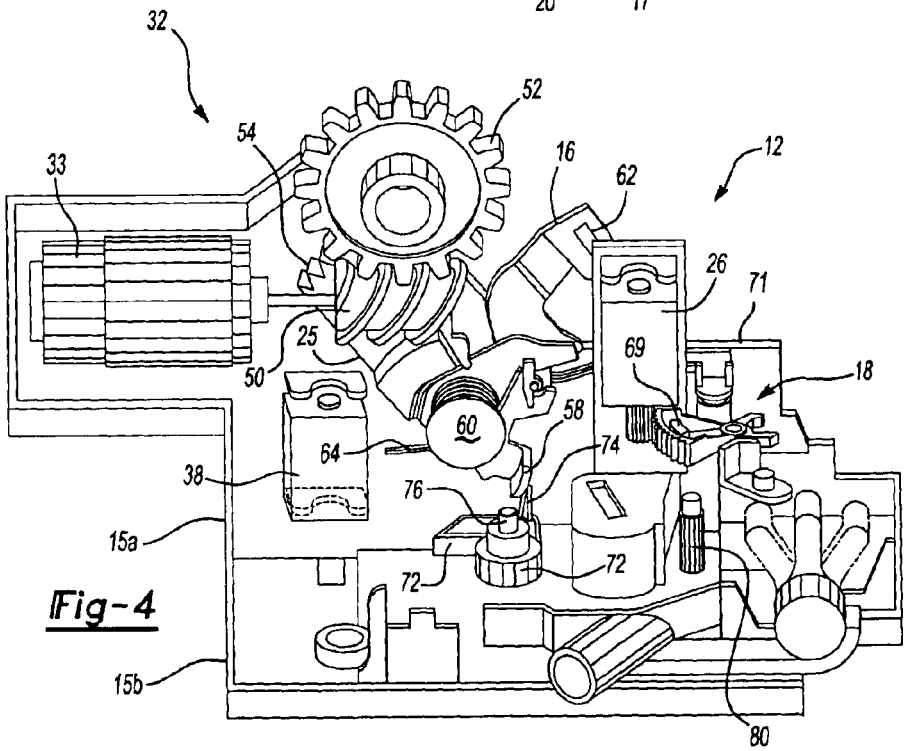
FIG. 4 shows a perspective view of the latch of FIG. 2 in a released state due to manual actuation of an associated inside door handle.

As shown in FIG. 4, manual inside release of the latch 12 is achieved by pulling the inside door handle 14, causing the inside release lever 16 to rotate counter-clockwise. When the latch 12 is not superlocked, the inside release lever 16 transmits drive to the intermediate release lever 25 by the engagement formation 68 on the arm 71. The claw 22 in then release in the same way as during the power release.

The latch 12 is further provided with an outside release lever 34 (FIG. 5) operably connected to an outside door handle 31. The outside release lever 34 is also capable of releasing the latch 12 when the outside locking mechanism 36 is unlocked. An outside locking motor 38 is illustrated in FIG. 4.

In normal operation of the latch 12, the latch 12 is released by using the power release actuator 32 in response to signals from the controller 30. The controller 30 processes inputs from either the inside door handle 14 or the outside door handle 31 to determine whether release of the latch 12 should occur. If there is a failure of the power release mechanism (due to a flat battery or accident, for example), the mechanical linkage from the inside door handle 14 or the outside door handle 31 can be used as a back-up. In such circumstances, the force supplied by a vehicle user to the inside door handle 14 and the outside door handle 31 may need to be higher than the force required for power release to be achieved.

Figure 5:
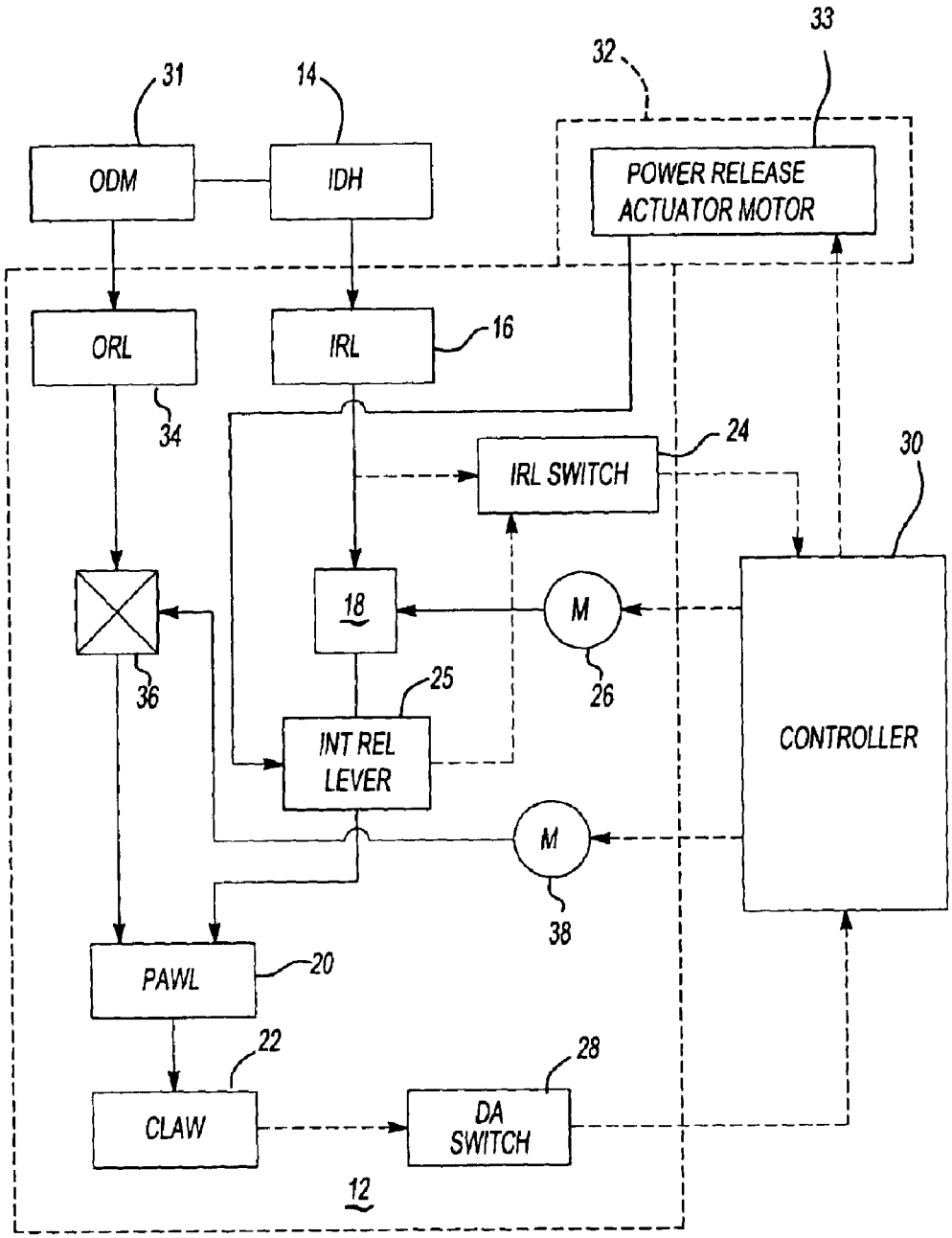
FIG. 5 shows a schematic diagram of the latch of FIG. 2 illustrating the connections to the inside and outside door handles and to a controller.

FIG. 5 illustrates a schematic diagram of the latch 12. Mechanical interconnections are illustrated by arrows with unbroken lines, whereas electrical connections are illustrated by arrows with broken lines.

By transmitting drive from the motor 33 via the intermediate release lever 25 that pivots about an axis substantially parallel to the shut face portion 15*b* of the retention plate 15, the motor 33 and gearing (the worm wheel 50 and the reduction gear 52) can be positioned in the plane of the inside face portion 15*a* of retention plate 15. This positioning is advantageous as there is more space in this part of the door 92 than in the part of the door that runs parallel to the shut face portion 15*b*. The claw 22 and the pawl 20 must be positioned parallel to the plane of the shut face 15*b* in shut face portion 95*b* of the latch 12 for the latch 12 to function properly, however.

It will further be appreciated by those skilled in the art that numerous changes may be made within the scope of the present invention. For example, the reduction gearing arrangement may be altered as required, the superlocking mechanism may be omitted so that the inside release lever 16 and the intermediate release lever 25 are integral or have a dog clutch connection therebetween.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A latch for a vehicle door comprising:

a first portion arranged substantially parallel to a shut face plane of the latch;

a second portion arranged substantially parallel to an inside face plane of the latch;

a power release mechanism to release the latch, wherein said power release mechanism is provided in said second portion;

an intermediate release lever, said power release mechanism driving said intermediate release lever; and an inside release lever pivotably mounted co-axially with said intermediate release lever.

2. The latch according to claim 1 wherein said intermediate release lever is pivotable about an intermediate release level axis that is substantally parallel to said shut face plane.

3. The latch according to claim 1 further including a resilient member that biases said intermediate release lever.

4. The latch according to claim 1 further including an inside door handle, and actuation of said inside door handle pivots said inside release lever to transmit drive to said intermediate release lever.

5. The latch according to claim 1 further including a superlocking mechanism that engages and disengages drive from said inside release lever to said intermediate release lever.

6. The latch according to claim 1 further including a pawl lifter, and said intermediate release lever engages said pawl lifter as said intermediate release lever is driven by said power release mechanism to rotate said pawl lifter.

7. The latch according to claim 6 wherein said pawl lifter is pivotable about a pawl lifter axis that is substantially parallel to said inside face plane.

8. The latch according to claim 6 further including a pawl that is pivotable about a pawl axis that is substantially parallel to said inside face plane, and said pawl lifter rotates said pawl as said pawl lifter rotates.

9. The latch according to claim 8 wherein said pawl engages a rotatable latch bolt pivotable about a latch bolt axis that is substantially parallel to said inside face plane, wherein said pawl releases said latch bolt as said pawl is rotated by said pawl lifter.

10. The latch according to claim 1 wherein said first portion is arranged substantially parallel to a shut face of the vehicle door and said second portion is arranged substantially parallel to an inside face of the vehicle door.

11. The latch according to claim 1 wherein said power release mechanism includes a motor and a reduction gear that engages said intermediate release lever, and said motor drives said reduction gear to pivot said intermediate release lever.

12. The latch according to claim 1 further including a control, wherein said power release mechanism is actuated by said control.

13. A latch for a vehicle door comprising:

a first portion arranged substantially parallel to a shut face plane of the latch;

a second portion arranged substantially parallel to an inside face plane of the latch;

a power release mechanism to release the latch, wherein said power release mechanism is provided in said second portion;

an intermediate release lever, said power release mechanism driving said intermediate release lever;

a pawl lifter, said intermediate release lever engaging said pawl lifter as said intermediate release lever is driven by said power release mechanism to rotate said pawl lifter; and a pawl pivotable about a pawl axis that is substantially parallel to said inside face plane, and said pawl lifter rotates said pawl as said pawl lifter rotates, wherein said pawl and said pawl lifter are co-axially mounted.

14. A latch for a vehicle door comprising:

a first portion arranged substantially parallel to a shut face plane of the latch;

a second portion arranged substantially parallel to an inside face plane of the latch;

a power release mechanism to release the latch, wherein said power release mechanism is provided in said second portion, and wherein said power release mechanism includes a motor and a reduction gear;

an intermediate release lever, said power release mechanism driving said intermediate release lever, wherein said reduction gear engages said intermediate release lever and said motor drives said reduction gear to pivot said intermediate release lever, wherein said intermediate release lever includes a cam surface; and a pawl lifter including a projection, and said cam surface engages said projection to rotate said pawl lifter as said motor drives said intermediate release lever, and said pawl lifter rotates a pawl.

15. A latch for a vehicle door comprising:

a first portion arranged substantially parallel to a shut face plane of the latch;

a second portion arranged substantially parallel to an inside face plane of the latch;

a power release mechanism to release a latch bolt, and said power release mechanism is provided in said second portion;

an intermediate release lever pivotable about an intermediate release lever axis that is substantially parallel to said shut face plane and driven by said power release mechanism;

a pawl lifter pivotable about a pawl lifter axis that is substantially parallel to said inside face plane, and said intermediate release lever rotates said pawl lifter as said intermediate release lever is driven by said power release mechanism;

a pawl mounted co-axially with said pawl lifter, and said pawl lifter rotates said pawl as said intermediate release lever rotates said pawl lifter;

said latch bolt pivotally mounted about a latch bolt axis that is substantially parallel to said inside face plane, and said pawl rotates to release said latch bolt when said pawl lifter rotates said pawl; and an inside release lever co-axially mounted with said intermediate release lever to manually release the latch.

16. The latch according to claim 15 further including a superlocking mechanism that engages and disengages drive from said inside release lever to said intermediate release lever.

17. The latch according to claim 15 wherein said first portion is arranged substantially parallel to a shut face of the vehicle door and said second portion is arranged substantially parallel to an inside face of the vehicle door.

* * * * *

UNITED STATES PATENT AND TRADEMARK OFFICE

CERTIFICATE OF CORRECTION

PATENT NO. : 6,863,318 B2
DATED : March 8, 2005
INVENTOR(S) : Mejean, Veronique and Madeddu, Marc It is certified that error appears in the above-identified patent and that said Letters Patent is hereby corrected as shown below:

Column 5,
Line 50, please replace "level" with -- lever --.

Signed and Sealed this

Sixteenth Day of August, 2005

JON W. DUDAS
*Director of the United States Patent and Trademark Office*